US010309419B2

(12) United States Patent
Cellier et al.

(10) Patent No.: US 10,309,419 B2
(45) Date of Patent: Jun. 4, 2019

(54) TURBOMACHINE CENTRE BLADE COMPRISING A CURVED PORTION

(71) Applicant: SAFRAN AIRCARFT ENGINES, Paris (FR)

(72) Inventors: Damien Cellier, Paris (FR); Alicia Lise Julia Dufresne, Paris (FR); Philippe Pierre Marcel Marie Pelletrau, Vaux-le-Penil (FR); Vincent Paul Gabriel Perrot, Maisons Alfort (FR); Jean-Francois Antoine Christian Rios, Nandy (FR); Laurent Christophe Francis Villaines, Vaux-Le-Penil (FR)

(73) Assignee: SAFRAN AIRCARFT ENGINES, Paris (FR)

( * ) Notice: Subject to any disclaimer, the term of this patent is extended or adjusted under 35 U.S.C. 154(b) by 285 days.

(21) Appl. No.: 14/349,000

(22) PCT Filed: Oct. 11, 2012

(86) PCT No.: PCT/FR2012/052314

§ 371 (c)(1),
(2) Date: Apr. 1, 2014

(87) PCT Pub. No.: WO2013/054049

PCT Pub. Date: Apr. 18, 2013

(65) Prior Publication Data

US 2014/0248144 A1 Sep. 4, 2014

(30) Foreign Application Priority Data

Oct. 13, 2011 (FR) ..... 11 59255

(51) Int. Cl.
*F04D 29/32* (2006.01)
*F04D 29/66* (2006.01)
(Continued)

(52) U.S. Cl.
CPC ..... *F04D 29/661* (2013.01); *F01D 5/141* (2013.01); *F01D 5/16* (2013.01); *F01D 9/041* (2013.01);
(Continued)

(58) Field of Classification Search
CPC .... F04D 29/661; F04D 29/403; F04D 29/324; F01D 5/141; F01D 5/16; F01D 9/041; F05D 2260/96
(Continued)

(56) References Cited

U.S. PATENT DOCUMENTS 3,745,629 A 7/1973 Pask et al.
2006/0222488 A1* 10/2006 Fessou ..... F01D 5/141 415/191
(Continued)

FOREIGN PATENT DOCUMENTS

CN 200949477 Y 9/2007
DE 10 2008 055 824 A1 5/2009
(Continued)

OTHER PUBLICATIONS

Combined Chinese Office Action and Search Report dated Feb. 15, 2015 in Patent Application No. 201280049007.1 (with English Translation and English Translation of Category of Cited Documents).
(Continued)

*Primary Examiner* — Laert Dounis
*Assistant Examiner* — Kelsey L Stanek
(74) *Attorney, Agent, or Firm* — Oblon, McClelland, Maier & Neustadt, L.L.P.

(57) ABSTRACT

A turbomachine compressor blade of main radial orientation with respect to a main axis of the turbomachine. The blade includes a radially internal root portion, a radially external tip portion, a radially intermediate portion, a curved portion
(Continued)

tangentially in a direction, and at least one straight portion on the root portion and/or on the tip portion.

8 Claims, 1 Drawing Sheet

(51) Int. Cl.
*F01D 5/14* (2006.01)
*F01D 5/16* (2006.01)
*F01D 9/04* (2006.01)
*F04D 29/40* (2006.01)

(52) U.S. Cl.
CPC ..... *F04D 29/324* (2013.01); *F04D 29/403* (2013.01); *F05D 2260/96* (2013.01)

(58) Field of Classification Search
USPC ..... 415/208.1, 191
See application file for complete search history.

(56) References Cited

U.S. PATENT DOCUMENTS

| | | | |
|---|---|---|---|
| 2008/0152504 | A1 | 6/2008 | Burton et al. |
| 2008/0152505 | A1 | 6/2008 | Burton et al. |
| 2009/0123276 | A1 | 5/2009 | Greim et al. |
| 2010/0150729 | A1 | 6/2010 | Kirchner et al. |
| 2010/0215503 | A1 | 8/2010 | Myoren et al. |
| 2012/0192421 | A1 | 8/2012 | Kirchner et al. |

FOREIGN PATENT DOCUMENTS

| | | | |
|---|---|---|---|
| EP | 1 462 608 | A1 | 9/2004 |
| EP | 1 939 405 | A2 | 2/2008 |
| EP | 1 939 398 | A2 | 7/2008 |
| EP | 2 199 543 | A2 | 6/2010 |
| EP | 2 226 468 | A2 | 9/2010 |
| JP | H06-212902 | A | 8/1994 |
| WO | WO 2011/124214 | A2 | 10/2011 |

OTHER PUBLICATIONS

U.S. Appl. No. 14/478,120, filed Sep. 5, 2014, Cellier, et al.
International Search Report dated Jan. 18, 2013, in PCT/FR12/052314 filed Oct. 11, 2012.

* cited by examiner

TURBOMACHINE CENTRE BLADE COMPRISING A CURVED PORTION

TECHNICAL FIELD

The invention relates to a turbomachine blade which is implemented in such a way as to limit the coincidences of vibrational frequencies of the blade in relation to the frequencies of solicitation of the blade during the operation of the turbomachine, which would risk resulting in a deterioration of the blade or even breakage of it.

PRIOR ART

During the operation of a turbomachine, the flow of gas along stator blades causes the blades to vibrate.

Each blade has one or several natural frequencies for which the amplitude of the vibration can become excessive and cause the deterioration or breakage of the blade.

U.S. Pat. No. 3,745,629 describes a turbomachine blade which is curved according to a profile which is similar to the profile of a blade in vibration in one of its natural frequencies.

This curvature makes it possible to limit the vibrations of the blade in a range of frequencies that correspond to the operating conditions of the turbomachine, and as such limit the risks of breakage of the blade.

However, such a curvature also reduces the effectiveness and the aerodynamic performance of the blade.

The invention has for purpose to propose a turbomachine blade which is carried out in such a way that the natural frequency or frequencies are different from the frequencies of solicitation of the blade during the operation of the turbomachine.

DESCRIPTION OF THE INVENTION

The invention proposes a turbomachine compressor blade of radial main orientation with respect to the main axis of the turbomachine, with the blade comprising a radially internal root portion, a radially external tip portion and a radially intermediate portion, characterised in that the blade comprises a curved portion in tangentially direction and at least one straight portion on the root portion and/or on the tip portion.

Such a tangentially curved portion modifies the vibrational response of the blade to the vibrational solicitations, and removes the frequencies at risk outside of the operating range of the blade.

More preferably, the radial length L1 of the curved portion is between 30% and 60% of the radial length L of the blade.

More preferably, the tangential amplitude A of the curved portion is between 1% and 5% of the radial length L of the blade.

More preferably, said straight portion is inclined by an angle less than or equal to 30° with respect to the main radial direction of the blade.

More preferably, the curved portion is positioned radially on the root portion.

More preferably, the curved portion is positioned radially on the tip portion.

More preferably, the curved portion is positioned radially on the median portion.

More preferably, the curved portion is tangentially curved in the direction of the intrados of the blade.

The invention also proposes a turbomachine compressor stator comprising radial blades distributed around the main axis of the turbomachine, characterised in that each blade is carried out such as defined hereinabove.

The invention also proposes a turbomachine comprising a stator that comprises blades such as defined hereinabove.

BRIEF DESCRIPTION OF THE DRAWINGS

Other characteristics and advantages of the invention shall appear when reading the following detailed description for the understanding of which reference will be made to the annexed figures along which.

DETAILED DESCRIPTION OF PARTICULAR EMBODIMENTS

In the following description, identical, similar or analogous elements shall be designated by the same reference numbers.

Figure 1:
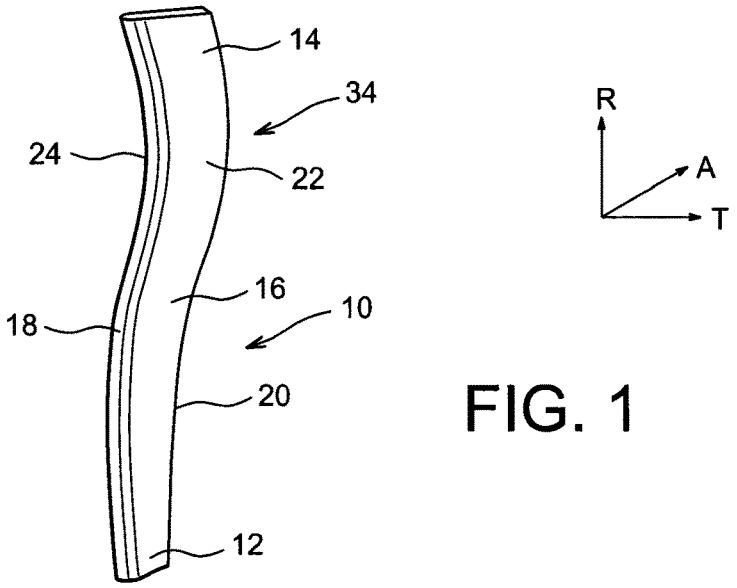
FIG. 1 is a diagrammatical drawing in perspective of a blade comprising a curved portion according to the invention.

For the description of the invention, in a non-limiting manner the radial, tangential and axial orientations shall be adopted according to the marking R, T, A shown in FIG. 1, wherein the radial orientation is the main orientation of the blade and the tangential orientation is the orientation perpendicular to a main axial plane of the blade.

FIG. 1 shows a blade 10 that is part of a stator (not shown) of the compressor of a turbomachine.

The compressor comprises a plurality of blades 10 which are evenly distributed around the main axis of the turbomachine, in order to form an annular set, called a rectifier grid, through which a flow of gas, here air, passes.

The blade 10 extends globally radially according to the orientation R with respect to the main axis of the turbomachine.

The blade 10 comprises a radially internal portion 12, called the root of the blade, on which the blade 10 is fixed to an inner ferrule of the compressor (not shown).

The blade 10 comprises a radially external portion 14 called the tip of the blade, on which the blade 10 is fixed to an outer ferrule of the compressor (not shown).

The blade 10 comprises an intermediate portion 16 that connects the root 12 to the tip 14 of the blade 10.

The inner ferrule and the outer ferrule of the compressor delimit an annular duct called a stream, wherein the flow of air flows and interacts with the blade 10.

The blade 10 further comprises a leading edge 18, which is located axially upstream according to the direction of the gas flow with respect to the blade 10, and a trailing edge 20 that is located axially downstream according to the direction of the gas with respect to the blade 10.

The blade 10 is furthermore cambered and comprises a face 22 called intrados, that is located on the side opposite the camber and a face 24 called extrados that is located on the side of the camber.

Figure 2:
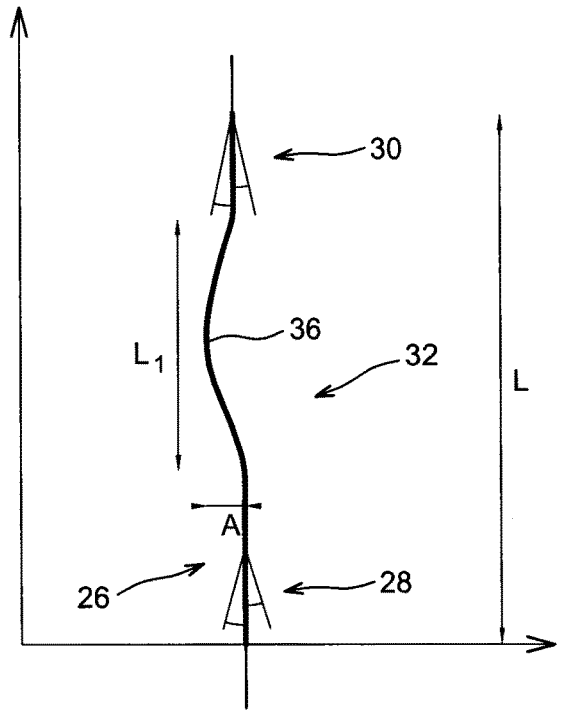
FIG. 2 shows the tangential stacking law of the centre of gravity of the sections of a blade according to the invention.

FIG. 2 shows a curve 26 showing the tangential stacking law of the centre of gravity of the sections of the blade 10.

This tangential stacking law corresponds to the position of the centre of gravity of each section of the blade according to a plane perpendicular to the main radial direction of the blade, with respect to the main radial axis of the blade 10.

This curve 26 comprises a root portion 28 corresponding to the root 12 of the blade 10, a tip portion 30 corresponding to the tip 14 of the blade 10 and an intermediate portion 32 corresponding to the intermediate portion of the blade 10.

According to the invention, the blade 10 is carried out in such a way that it comprises a portion 34 that is curved tangentially and at least one straight portion.

As such, as can be seen in more detail in FIG. 2, the curve 26 comprises a tangentially curved portion 36 corresponding to the curved portion 34. The curve 26 further comprises at least one curved portion corresponding to the straight portion of the blade 10.

According to the invention, the straight portion of the blade 10 is located on the root 12 and/or on the tip 14 of the blade 10, according to the position of the curved portion 34.

As such, the straight portion of the curve 26 is located on the root portion 28 and/or on the tip portion 30, according to the radial position of the curved portion 36.

According to a first aspect of the invention, the curved portion 34 is located radially on the root 12 of the blade 10. The straight portion is then located on the tip 14 of the blade 10. Consequently, the curved portion 36 is located radially on the root portion 28 and tip portion 30 of the curve 26 is straight.

According to a second aspect of the invention, the curved portion 34 is located radially on the tip 14 of the blade 10. The straight portion is then located on the root 12 of the blade 10. The curved portion 36 of the curve 26 is consequently located radially on the tip portion 30 and the root portion 28 of the curve 26 is straight.

According to a third aspect of the invention, the curved portion 34 is located radially on the intermediate portion 16 of the blade 10. The root 12 and the tip 14 of the blade 10 each form a straight portion of the blade 10.

Consequently, the curved portion 36 is located radially on the intermediate portion 32 and the root portion 28 and the tip portion 30 of the curve 26 are both straight.

Furthermore, according to a preferred embodiment, the blade 10 is curved in such a way that the curved portion 34 is tangentially curved in the direction of the intrados 22, as shown in FIG. 1.

According to an alternative embodiment not shown, the curved portion 34 is curved in the direction of the extrados 24.

The dimensions of the curved portion 36 are defined with respect to the radial length "L" of the blade 10.

As such, the radial dimension "L1" of the curved portion 36 is between 30% and 60% of the radial dimension "L" of the blade 10.

As such, the tangential dimension "A" of the curved portion 36 is between 1% and 5% of the radial dimension "L" of the blade 10.

As was mentioned hereinabove, according to the radial position of the curved portion, the root portion 28 and/or the tip portion 30 is straight.

In this case, each root portion 28 and/or tip portion 30 that is straight, is inclined with respect to the main radial direction of the blade by an angle of which the value is less than or equal to 30°.

The invention claimed is:

1. A turbomachine compressor blade of main radial orientation with respect to a main axis of the turbomachine, the blade comprising:

a radially internal root portion;

a radially external tip portion;

a radially intermediate portion;

a curved portion perpendicularly to a main axial plane of the blade in a direction; and at least one straight portion on at least one of the root portion and the tip portion, wherein a tangential amplitude of the curved portion is between 1% and 5% of a radial length of the blade, and wherein, when the blade is at rest, the straight portion is inclined by a non-zero angle less than or equal to 30° with respect to a main radial direction of the blade.

2. A blade as claimed in claim 1, wherein a radial length of the curved portion is between 30% and 60% of the radial length of the blade.

3. A blade as claimed in claim 1, wherein the curved portion is positioned radially on the root portion.

4. A blade according to 1, wherein the curved portion is positioned radially on the tip portion.

5. A blade according to claim 1, wherein the curved portion is positioned radially on the intermediate portion.

6. A blade as claimed in claim 1, wherein the curved portion is tangentially curved in a direction of intrados of the blade.

7. A turbomachine compressor stator comprising:

radial blades distributed around the main axis of the turbomachine, wherein each blade is a blade as claimed in claim 1.

8. A turbomachine comprising a stator that comprises blades as claimed in claim 7.

* * * * *